US007608337B2

(12) United States Patent
Tanaka et al.

(10) Patent No.: US 7,608,337 B2
(45) Date of Patent: Oct. 27, 2009

(54) CHEMICAL CONVERSION-TREATED METAL PLATE

(75) Inventors: Koki Tanaka, Futtsu (JP); Masao Kimura, Futtsu (JP); Hiromasa Shoji, Futtsu (JP); Hiromasa Nomura, Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 10/579,372

(22) PCT Filed: Nov. 18, 2004

(86) PCT No.: PCT/JP2004/017514

§ 371 (c)(1),
(2), (4) Date: Jul. 11, 2006

(87) PCT Pub. No.: WO2005/049888

PCT Pub. Date: Jun. 2, 2005

(65) Prior Publication Data

US 2007/0031689 A1 Feb. 8, 2007

(30) Foreign Application Priority Data

Nov. 18, 2003 (JP) ..... 2003-387715

(51) Int. Cl.
*C23C 22/34* (2006.01)
*B32B 9/00* (2006.01)
*B32B 15/04* (2006.01)

(52) U.S. Cl. ..... 428/472; 428/469; 428/472.1

(58) Field of Classification Search ..... 428/632, 428/633, 628, 629, 457, 469, 472, 688, 689, 428/702, 472.1

See application file for complete search history.

(56) References Cited

U.S. PATENT DOCUMENTS

| | | | | | |
|---|---|---|---|---|---|
| 5,156,720 | A | * | 10/1992 | Rosenfeld et al. | 205/76 |
| 5,380,374 | A | * | 1/1995 | Tomlinson | 148/247 |
| 5,942,333 | A | * | 8/1999 | Arnett et al. | 428/469 |
| 2002/0090529 | A1 | * | 7/2002 | Ueda et al. | 428/632 |
| 2002/0114971 | A1 | * | 8/2002 | Yamamoto et al. | 428/632 |
| 2005/0267004 | A1 | * | 12/2005 | Abd Elhamid et al. | 510/175 |

FOREIGN PATENT DOCUMENTS

| | | | |
|---|---|---|---|
| EP | 1 205 580 | | 5/2002 |
| EP | 1 405 933 | A1 | 4/2004 |
| JP | 05-230666 | | 9/1993 |
| JP | 08-73775 | | 3/1995 |
| JP | 11-029724 | | 2/1999 |
| JP | 2000-263695 | | 9/2000 |
| JP | 2002-194557 | | 7/2002 |
| JP | 2002-194558 | | 7/2002 |
| JP | 2002-317279 | * | 10/2002 |
| JP | 2003-155578 | | 5/2003 |
| WO | WO 02/103080 | A | 12/2002 |

OTHER PUBLICATIONS

Supplementary European Search Report dated Jul. 1, 2008 issued in corresponding European Application No. 04 79 9803.

* cited by examiner

*Primary Examiner*—John J. Zimmerman
*Assistant Examiner*—Aaron Austin
(74) *Attorney, Agent, or Firm*—Kenyon & Kenyon LLP

(57) ABSTRACT

To provide a chemical conversion-treated metal sheet excellent in the corrosion resistance and coating adhesion, free from elution of chromium oxide and small in the environmental load, there is provided a chemical conversion-treated metal sheet comprising a metal sheet having on at least one surface thereof an inorganic film, wherein the inorganic film is a film comprising as a main component one or both of a metal oxide and a metal hydroxide exclusive of Cr and the film contains F.

13 Claims, No Drawings

CHEMICAL CONVERSION-TREATED METAL PLATE

TECHNICAL FIELD

The present invention relates to a chemical conversion-treated metal sheet having a small environmental load and an excellent corrosion resistance, which is used for automobiles, building materials, home appliances and electric devices.

BACKGROUND ART

In the metal sheet used for automobiles, building materials, home appliances and electric devices, a film comprising a chromium oxide is formed on the metal sheet surface to impart excellent corrosion resistance owing to the self-repairing function of the chromium oxide and thereby enhance the design property and corrosion resistance. Also, at the coating, a chromate treatment is applied as an undercoating treatment so as to enhance the corrosion resistance. However, from the standpoint of protecting the global environment, it is recently required to prevent the elution of chromate oxide. Consequently, a chromium-free surface film for the metal sheet or an undercoating treatment method not using a chromate treatment is being demanded.

In order to satisfy these requirements, for example, a resin chromate film obtained by compounding an organic resin and a chromate has been proposed in Japanese Unexamined Patent Publication (Kokai) No. 5-230666. However, this technique has a problem that the elution of chromium oxide can be decreased but cannot be completely prevented.

On the other hand, a treatment technique not using a chromate has been also developed. For example, Japanese Unexamined Patent Publication (Kokai) No. 11-29724 discloses a method of covering the metal sheet surface with a film comprising an aqueous resin having incorporated therein a thiocarbonyl group-containing compound, a phosphate ion and a water-dispersible silica. However, this technique has a problem that although the corrosion resistance is improved, the adhesion of the coating material is insufficient in uses where severe working is applied.

Also, Japanese Unexamined Patent Publication (Kokai) No. 8-73775 discloses an acidic surface treating agent containing two kinds of silane coupling agents. This technique has a problem that although good adhesion of the coating material can be obtained, the corrosion resistance is not satisfied.

Under these circumstances, the present invention provides a chemical conversion-treated metal sheet excellent in the corrosion resistance and coating adhesion, free from elution of chromium oxide and small in the environmental load.

DISCLOSURE OF THE INVENTION

As a result of intensive investigations to solve the above-described problems, the present inventors have succeeded in providing a metal sheet excellent in the corrosion resistance and coating adhesion and free from elution of chromium oxide by forming an inorganic film comprising an F-containing metal oxide or metal hydroxide (excluding Cr) on the metal surface. Incidentally, the present inventors have found that this metal sheet can be obtained by dipping a metal sheet in a treating aqueous solution containing, alone or as a composite, one or more metal ion selected from Ti ion, Zr ion and Si ion and containing one or both of F ion and F-containing complex ion at a molar ratio of 6.5 times or more to the metal ion, with the pH of the aqueous solution being adjusted to 2 to 7, and if desired, when a metal sheet having on the surface thereof a phase differing in the potential formed by adding, alone or as a composite, one or more ion selected from Zn ion, Al ion, Mg ion, Ni ion and Co ion is dipped in the above-described aqueous solution, a high-quality chemical conversion-treated metal sheet can be easily and simply obtained.

That is, the gist of the present invention is as follows.

(1) A chemical conversion-treated metal sheet comprising a metal sheet having on at least one surface thereof an inorganic film, wherein the inorganic film is a film comprising as a main component one or both of a metal oxide and a metal hydroxide exclusive of Cr and the film contains F.

(2) The chemical conversion-treated metal sheet as described in (1) above, wherein the content of said one or both of a metal oxide and a metal hydroxide is 50 atom % or more based on said film exclusive of F.

(3) The chemical conversion-treated metal sheet as described in (1) above, wherein the content of said one or both of a metal oxide and a metal hydroxide is 80 atom % or more based on said film exclusive of F.

(4) The chemical conversion-treated metal sheet as described in (1) above, wherein the content of said one or both of a metal oxide and a metal hydroxide is 90 atom % or more based on said film exclusive of F.

(5) The chemical conversion-treated metal sheet as described in any one of (1) to (4) above, wherein the content of F in said film is from 1 atom % to less than 60 atom %.

(6) The chemical conversion-treated metal sheet as described in any one of (1) to (4) above, wherein the content of F in said film is from 3 atom % to 35 atom %.

(7) The chemical conversion-treated metal sheet as described in any one of (1) to (4) above, wherein the content of F in said film is from 5 atom % to 30 atom %.

(8) The chemical conversion-treated metal sheet as described in any one of (1) to (7) above, wherein at least a part of the metal component of said film has both a bond to O and a bond to F.

(9) The chemical conversion-treated metal sheet as described in any one of (1) to (7) above, wherein the metal component of said film is one or more member selected from the group consisting of Ti, Zr and Si.

(10) The chemical conversion-treated metal sheet as described in (9) above, wherein said film further contains, as an additional element, one or more element selected from the group consisting of Mg, Al, Zn, Ni and Co.

(11) The chemical conversion-treated metal sheet as described in (10) above, wherein the content of the additional element in said film is such that the Zn content is from 0.1 atom % to less than 50 atom %.

(12) The chemical conversion-treated metal sheet as described in (10) or (11) above, wherein the content of the additional element in said film is such that the Al content is from 1 atom % to less than 30 atom %.

(13) The chemical conversion-treated metal sheet as described in any one of (10) to (12) above, wherein the content of the additional element in said film is such that the Mg content is from 1 atom % to less than 30 atom %.

(14) The chemical conversion-treated metal sheet as described in any one of (10) to (13) above, wherein the content of the additional element in said film is such that the Ni content is from 1 atom % to less than 30 atom %.

(15) The chemical conversion-treated metal sheet as described in any one of (10) to (14) above, wherein the content of the additional element in said film is such that the Co content is from 1 atom % to less than 30 atom %.

(16) The chemical conversion-treated metal sheet as described in any one of (10) to (15) above, wherein the additional element in said film has a bond to 0 or F or both a bond to O and a bond to F.

BEST MODE FOR CARRYING OUT THE INVENTION

The chemical conversion-treated metal sheet of the present invention is characterized by being excellent in the corrosion resistance and adhesion of coating material, free from elution of chromium oxide and small in the environmental load. In order to impart these characteristic features, in the present invention, a film mainly comprising one or both of a metal oxide and a metal hydroxide (hereinafter called "a metal oxide or the like") is formed on one surface or both surfaces of a metal sheet and F is incorporated into the film. It is considered that F bonded to the metal component in the film is stronger in the action of withdrawing an electron than oxygen O bonded to the metal component and therefore, a firmer film is obtained, as a result, the corrosion resistance and adhesion to a coating material are enhanced.

The expression "a film comprising one or both of a metal oxide and a metal hydroxide as a main component" means that the metal oxide and metal hydroxide is contained in an amount of 50 atom % or more of the film excluding F. The preferred amount is 80 atom % or more, more preferred amount is 90 atom % or more and particularly preferred amount is 95 atom % or more.

The amount of F contained in the film is preferably from 1 atom % to less than 60 atom % in terms of the component content in the film. If the F content is less than 1 atom %, insufficient corrosion resistance may result, whereas if the F content is 60 atom % or more, formation of the film mainly comprising a metal oxide or the like is inhibited. The preferred amount of F is 3 atom % to 35 atom %, more preferably from 5 atom % to 30 atom %, particularly preferably 5 atom % to 20 atom %. In order to allow for formation of firm film and enhancement of corrosion resistance by the above-described action of F, the metal element in the film preferably has both a bond to O atom and a bond to F atom.

In the present invention, the film formed on the surface of a metal sheet preferably comprises one or both of an oxide and a hydroxide of Si, Ti or Zr. These metal oxides and the like may be used individually or in combination of two or more thereof. The reason why Si, Ti and Zr are selected as the metal component of the film is because the metal oxide or the like thereof can form a film on the metal sheet surface at a low cost and the film is excellent in the corrosion resistance and adhesion to the metal sheet. In order to allow for formation of firm film and enhancement of corrosion resistance, Si, Ti or Zr is preferably rendered to have both a bond to O and a bond to F in the film.

Furthermore, in the present invention, the film comprising the above-described F-containing metal oxide or the like preferably contains, as the additional element, one or more element selected from Zn, Al, Mg, Ni and Co. The content of the additional element is preferably such that Zn is from 0.1 atom % to less than 50 atom %, more preferably from 1 atom % to 20 atom %, Al is from 1 atom % to less than 30 atom %, more preferably from 1 atom % to 20 atom %, Mg is from 1 atom % to less than 30 atom %, more preferably from 1 atom % to 15 atom %, Ni is from 1 atom % to less than 30 atom %, more preferably from 1 atom % to 15 atom %, and Co is from 1 atom % to less than 30 atom %, more preferably from 1 atom % to 15 atom %. Such an element is added to more enhance the adhesion between the metal sheet and the film and if the content thereof is less than the specified range, the effect of improving the adhesion may not be obtained, whereas if added excessively, this highly probably gives rise to deterioration of the corrosion resistance or increase in the production cost.

In the film, the additional element is preferably present in the state of being bonded to O or F or bonded to both O and F, that is, Zn is present in the form of either Zn—O or Zn—F or in both of these bonding forms, Al is present in the form of either Al—O or Al—F or in both of these bonding forms, Mg is present in the form of either Mg—O or Mg—F or in both of these bonding forms, Ni is present in the form of either Ni—O or Ni—F or in both of these bonding forms, and Co is present in the form of either Co—O or Co—F or in both of these bonding forms. The elements added each can be stably present in the film by taking such a bonding form and the corrosion resistance of the metal sheet is more enhanced.

The chemical conversion-treated metal sheet of the present invention is not particularly limited in its production method as long as a film structure specified in the present invention can be obtained, and may be produced by a vapor phase process such as sputtering and CVD or by a sol-gel process widely employed as the production method of an oxide film.

Also, in the production of the chemical conversion-treated metal sheet of the present invention, when a liquid phase deposition process using an aqueous solution of an F compound such as fluoro-complex ion is used, the production cost can be made low because of no use of an expensive vacuum evacuation system required in the vapor phase process and, furthermore, the measure for the formation of voids in the film resulting from generation of volatile components in the firing step, which occurs in forming a film by a sol-gel process, is not necessary. In addition, it is considered that according to the liquid phase deposition process, the film formed on the surface of the chemical conversion-treated metal sheet of the present invention comprises the basic unit having a structure where a metal is bonded with oxygens therearound and these basic units are bonded to each other, and when the film contains F, the basic units are arrayed to give a dense film.

The method for producing the chemical conversion-treated metal sheet of the present invention by the above-described liquid phase deposition process using an aqueous fluorine compound solution is described below.

An aqueous solution of an F compound where a metal element as the component of the film and F are compounded is prepared and used as the treating solution. More specifically, a treating aqueous solution containing, alone or as a composite, one or more metal element selected from Ti ion, Zr ion and Si ion and containing one or both of F ion and F-containing complex ion at a molar ratio of 6.5 times or more to the metal ion is adjusted to a pH of 2 to 7 and if desired, one or more ion selected from Zn ion, Al ion, Mg ion, Ni ion and Co ion is added alone or as a composite to the aqueous solution to prepare a treating solution.

When a metal sheet to be treated is dipped in this treating solution, at least one reaction out of the consumption of F ion and the reduction of H ion takes place, a reaction of converting a metal ion into a metal oxide or the like proceeds, and the metal oxide or the like deposit on the metal sheet surface. When the metal sheet to be treated has on the surface thereof a phase differing in the potential, such as aluminum alloy or zinc-aluminum alloy plating sheet, local cells are formed between the phases, as a result, the F ion consumption reaction and H ion reduction reaction efficiently occur and the deposition rate increases. In addition to such mere dipping, when the metal sheet to be treated is short-circuited with a metal material having a standard electrode potential lower than that of the metal sheet, an anode reaction takes place only on the metal material having a low standard electrode potential and therefore, the metal oxide or the like can be more efficiently deposited on the metal sheet. Also, when an insoluble material and a metal sheet to be treated are dipped in the above-described treating solution and a hydrogen ion reduction reaction is caused to proceed on the metal sheet while controlling the insoluble material to undertake an anodic reaction and the metal sheet to undertake a cathodic reaction, the oxide or hydroxide can be deposited on the meal sheet due to elevation of the interface pH along the progress of the reduction reaction. By controlling the hydrogen generating reaction and the elevation of interface pH within the range of not inhibiting the film formation, the deposition rate can be increased. As for the consumption of fluorine ion, boron ion or aluminum ion for forming a stable fluoride may be added to the treating solution. When the potential is controlled to an extent of not bringing about deposition reaction inhibition due to generation of hydrogen gas, a uniform film can be formed within a short time. The control of potential can be facilitated by setting the bath pH to an appropriate range, because if the pH of the treating solution is too low, a vigorous hydrogen reduction reaction readily occurs. In other words, the deposition rate can be increased by controlling the hydrogen generating reaction. Therefore, the pH of the treating solution is adjusted to 2 to 7.

In an aqueous solution where metal ion and fluorine ion in a molar ratio of 4 times or more to the metal ion are present together, and/or in an aqueous solution containing a complex ion comprising a metal and fluorine in a molar ratio of 4 times or more to the metal, an equilibrium reaction involving the fluorine ion occurs between the metal ion and one or both of an oxide and a hydroxide. As the fluorine ion or hydrogen ion is consumed or reduced, a reaction of converting the metal ion into one or both of an oxide and a hydroxide proceeds. In this reaction, when the F ion content in the aqueous solution is set to 6.5 times or more the content of the metal ion, the F ion is taken into one or both of an oxide and a hydroxide, and a bond connecting the metal ion to F atom and a bond connecting the meal ion to O atom can be formed in the film.

The deposition very slowly proceeds only by the operation of dipping the metal sheet to be treated in a treating solution, but when an insoluble electrode is dipped in the treating solution and a cathode overvoltage of several mV to hundreds of mV is applied to a substrate on which the metal oxide or the like are intended to deposit, the deposition rate is remarkably increased. At this time, a very homogeneous film is formed on the surface of the metal sheet to be treated, though a hydrogen gas is generated. If the pH of the treating solution is rendered to be lower so as to accelerate the generation of this gas, a film may not be formed or a film having a non-uniform thickness or a poor adhesive strength may result. From these reasons, the pH of the treating solution is preferably from 2 to 7, more preferably from 3 to 4. If the pH of the treating solution is less than 2, the film formation is readily inhibited due to generation of hydrogen and the potential control for sound film formation becomes difficult, whereas if the pH of the treating solution exceeds 7, the solution is unstable or an aggregate may be deposited to give an insufficient adhesive strength.

If the molar ratio of fluorine ion to the metal ion in the treating solution is less than 4 times, a film may not be deposited or if deposited, very little. By setting the molar ratio of fluorine ion to the metal ion in the treating solution to 6.5 times or more, the fluorine ion in the treating solution is taken into an oxide of the film in the process of depositing the film and a fluorine-containing film comprising one or both of a metal oxide and a metal hydroxide is formed.

The metal sheet to which the present invention is applied is not particularly limited but, for example, the present invention can be used for enhancing the corrosion resistance of a steel sheet, a stainless steel sheet, an aluminum alloy sheet, a copper sheet or a metal sheet having a plated surface. Also, when the film is used as an undercoating film of a coated steel sheet and the like, the corrosion resistance and the adhesion between resin and metal can be enhanced.

Examples of the stainless steel sheet include ferrite stainless steel sheet, martensite stainless steel sheet and austenite stainless steel sheet. Examples of the aluminum sheet and aluminum alloy sheet include JIS1000 series (pure Al type), JIS2000 series (Al—Cu type), JIS3000 series (Al—Mn type), JIS4000 series (Al—Si type), JIS5000 series (Al—Mg type), JIS6000 series (Al—Mg—Si type) and JIS7000 series (Al—Zn type). Examples of the plated steel sheet include Zn-plated steel sheet, Ni-plated steel sheet, Sn-plated steel sheet, Zn—Fe alloy-plated steel sheet and Zn—Ni alloy-plated steel sheet. Examples of the metal sheet having on the surface thereof a phase differing in the potential include aluminum alloy sheet, Zn—Al alloy-plated steel sheet, Zn—Al—Mg alloy plated steel sheet, Zn—Al—Mg—Si alloy-plated steel sheet, Al—Si alloy-plated sheet and Al—Zn—Si alloy-plated sheet. Also, coating may be applied to the chemical conversion-treated metal sheet of the present invention.

EXAMPLE

The present invention is described in greater detail below by referring to Example, but the present invention is not limited to this Example.

The metal sheet used were hot-dip galvanized steel sheet (plating coverage on both surfaces: 100 g/m$^2$) and stainless steel sheet (SUS304), and the metal sheet having on the surface thereof a phase differing in the potential used were a hot-dip 55% Al-43.4% Zn-1.6% Si alloy-plated steel sheet (plating coverage on both surfaces: 150 g/m $^2$), a Zn-11% Al-3% Mg-0.2% Si alloy-plated steel sheet (plating coverage on both surfaces: 120 g/m$^2$) and an aluminum alloy sheet (JIS A 3005 (Al—Mn type)). These metal sheets all had a thickness of 0.8 mm. Each metal sheet sample was subjected to an alkali degreasing treatment and then to the tests described below.

A metal oxide and a metal hydroxide were formed on the surface of each metal sheet by a liquid phase process.

The treating solutions used in the liquid phase process were an aqueous 0.1 mol/L ammonium hexafluorosilicate solution (treating solution (1)), an aqueous 0.1 mol/L ammonium hexafluorotitanate solution (treating solution (2)), an aqueous 0.1 mol/L ammonium hexafluorozirconate solution (treating solution (3)), a mixed aqueous solution of an aqueous 0.05 mol/L ammonium hexafluorotitanate solution and an aqueous 0.05 mol/L ammonium hexafluorosilicate solution (treating solution (4)), a mixed aqueous solution of an aqueous 0.05 mol/L ammonium hexafluorotitanate solution and an aqueous 0.05 mol/L ammonium hexafluorozirconate solution (treating solution (5)), a mixed aqueous solution of an aqueous 0.05 mol/L ammonium hexafluorozirconate solution and an aqueous 0.05 mol/L ammonium hexafluorosilicate solution (treating solution (6)), a mixed aqueous solution of an aqueous 0.03 mol/L ammonium hexafluorotitanate solution, an aqueous 0.03 mol/L ammonium hexafluorosilicate solution and an aqueous 0.03 mol/L ammonium hexafluorozirconate solution (treating solution (7)), a mixed aqueous solution of an aqueous 0.1 mol/L ammonium hexafluorosilicate solution and an aqueous 0.01 mol/L zinc chloride solution (treating solution (8)), a mixed aqueous solution of an aqueous 0.1 mol/L ammonium hexafluorotitanate solution and an aqueous 0.01 mol/L zinc chloride solution (treating solution (9)), a mixed aqueous solution of an aqueous 0.1 mol/L ammonium hexafluorozirconate solution and an aqueous 0.01 mol/L zinc chloride solution (treating solution (10)), a mixed aqueous solution of an aqueous 0.1 mol/L ammonium hexafluorosilicate solution and an aqueous 0.01 mol/L magnesium chloride solution (treating solution (11)), a mixed aqueous solution of an aqueous 0.1 mol/L ammonium hexafluorotitanate solution and an aqueous 0.01 mol/L magnesium chloride solution (treating solution (12)), a mixed aqueous solution of an aqueous 0.1 mol/L ammonium hexafluorozirconate solution and an aqueous 0.01 mol/L magnesium chloride solution (treating solution (13)), a mixed aqueous solution of an aqueous 0.1 mol/L ammonium hexafluorosilicate solution and an aqueous 0.01 mol/L aluminum chloride solution (treating solution (14)), a mixed aqueous solution of an aqueous 0.1 mol/L ammonium hexafluorotitanate solution and an aqueous 0.01 mol/L aluminum chloride solution (treating solution (15)), a mixed aqueous solution of an aqueous 0.1 mol/L ammonium hexafluorozirconate solution and an aqueous 0.01 mol/L aluminum chloride solution (treating solution (16)), a mixed aqueous solution of an aqueous 0.1 mol/L ammonium hexafluorosilicate solution and an aqueous 0.01 mol/L nickel chloride solution (treating solution (17)), a mixed aqueous solution of an aqueous 0.1 mol/L ammonium hexafluorotitanate solution and an aqueous 0.01 mol/L nickel chloride solution (treating solution (18)), a mixed aqueous solution of an aqueous 0.1 mol/L ammonium hexafluorozirconate solution and an aqueous 0.01 mol/L nickel chloride solution (treating solution (19)), a mixed aqueous solution of an aqueous 0.1 mol/L ammonium hexafluorosilicate solution and an aqueous 0.01 mol/L cobalt chloride solution (treating solution (20)), a mixed aqueous solution of an aqueous 0.1 mol/L ammonium hexafluorotitanate solution and an aqueous 0.01 mol/L cobalt chloride solution (treating solution (21)), and a mixed aqueous solution of an aqueous 0.1 mol/L ammonium hexafluorozirconate solution and an aqueous 0.01 mol/L cobalt chloride solution (treating solution (22)).

The treating solutions (1) to (7) were adjusted by mainly using ammonium fluoride and further, if desired, hydrofluoric acid or aqueous ammonia in the aqueous hexafluoro-complex salt solution such that the molar ratio of metal to entire fluorine was about 1:6.5 and the pH was about 3. The treating solutions (8) to (22) were adjusted, after adding the chloride to the aqueous hexafluoro-complex salt solution, by mainly using ammonium fluoride and further, if desired, hydrofluoric acid or aqueous ammonia such that the molar ratio of metal species of hexafluoro-complex salt to entire fluorine was about 1:6.5 and the pH was about 3.

Each degreased metal sheet was dipped in the treating solution and a film of metal oxide and metal hydroxide was formed on the metal sheet by cathodic electrolysis using a platinum as the counter electrode. The film formation was performed at room temperature for 5 minutes by controlling the current density to 100 mA/cm$^2$ and after the film formation, the metal sheet was washed with water and dried. In the samples using treating solutions (1) to (7), the fluorine ion in the treating solution was taken into an oxide of the film in the process of depositing the film and a fluorine-containing metal oxide or metal hydroxide film was formed. In the samples using treating solutions (8) to (22), the metal ion and fluorine ion in the mixed aqueous solution were taken into the film and a metal oxide or metal hydroxide film containing an additional element and fluorine were formed.

As for the degreased-hot-dip 55% Al-43.4% Zn-1.6% Si alloy-plated steel sheet and Zn-11% Al-3% Mg-0.2% Si alloy-plated steel sheet, the film formation was performed also by a so-called dipping process of dipping the metal sheet in the treating solution (1), (2) or (3) for 7 minutes and after film formation, water-washing and drying it. In this case, a metal oxide or metal hydroxide film having taken thereinto the fluorine ion in the treating solution and a metal ion considered to have dissolved out due to formation of local cells was formed.

For the purpose of comparison, a film comprising only $SiO_2$, $TiO_2$ or $ZrO_2$ was formed on the metal sheet by a sputtering process using $SiO_2$, $TiO_2$ or $ZrO_2$ as the target, respectively.

These films formed by the above-described liquid phase process or vapor phase process each was subjected to determination of amounts of elements contained in the film by the X-ray photoelectric spectroscopy. Also, the bonded state of the additional elements in the film was estimated from the chemical shift on the photoelectric spectrum of each element determined by the X-ray photoelectric spectroscopy. Furthermore, metal atoms, F atom, O atom and peripheral fine structure were examined by the XAFS (X-ray absorption fine-structures) method and each bonded state was estimated.

Out of the thus-produced various chemical conversion-treated metal sheets, the naked corrosion resistance of the hot-dip galvanized steel sheet was evaluated by performing a continuous salt spray test for 500 hours according to JIS Z 2371. The rust generated was rated AA when the white rust generation ratio was 5% or less, rated BB when the white rust generation ratio was from 5% to 10% or less, rated CC when the red rust generation ratio was 5% or less, and rated DD when the red rust generation ratio was more than 5%. Samples rated BB or higher (AA) were judged good. Other metal sheets were not subjected to the evaluation of naked corrosion resistance by a continuous salt spray test, because the metal sheets themselves had good corrosion resistance.

Also, the obtained various chemical conversion-treated metal sheets each was coated under the following conditions to make a coated metal sheet. First, an epoxy-based primer coating material (P655, produced by Nippon Fine Coatings K.K.) using a chromate-free rust-preventive pigment was coated as the primer-coating material to a dry film thickness of 5 μm and further thereon, a high molecular polyester-based coating material (NSC200HQ, produced by Nippon Fine Coatings K.K.) was coated to a dry film thickness of 15 μm. These coated metal sheets were evaluated on the coating material adhesion and corrosion resistance under the following conditions.

1) Coating Material Adhesion

The clear coated metal sheet produced by the above-described method was dipped in boiling water for 60 minutes. Thereafter, crosscuts were formed thereon according to the crosscut test method described in JIS K 5400 and further an Erichsen process of 7 mm was applied. A pressure-sensitive adhesive tape (cellophane tape produced by Nichiban Co., Ltd.) was laminated on the processed part and then swiftly peeled off by pulling it toward the oblique direction of 45°, and the number of peeled crosscuts out of 100 crosscuts was counted. The adhesion was evaluated on a 5-stage scale according to the peeling criteria shown in Table 1 and scores of 3 or higher were ranked as "passed".

TABLE 1

| Score | Rating Criteria of Coating Material Adhesion |
|---|---|
| 5 | No peeling |
| 4 | Peeled area ratio of less than 5% |
| 3 | Peeled area ratio of 5% to less than 20% |
| 2 | Peeled area ratio of 20% to less than 70% |
| 1 | Peeled area ratio of 70% or more |

2) Coating Corrosion Resistance Test

A sample for coating corrosion resistance test was prepared by cutting the right and left cut-end faces into an upper flash and a lower flash and according to the neutral salt spray cycle test described in JIS H 8502, 180 cycles were performed with one cycle consisting of spraying of an aqueous 5 wt % NaCl solution (2 hours)→drying (60° C., RH: 20 to 30%, 4 hours)→wetting (50° C., RH: 95% or more). The maximum blister width from the cut end face part was evaluated. The samples were rated on a 5-stage scale according to the blister width criteria shown in Table 2 and scores of 3 or higher were ranked as "passed".

TABLE 2

| Score | Rating Criteria of Corrosion Resistance |
|---|---|
| 5 | No blister |
| 4 | Maximum blister width of less than 3 mm |
| 3 | Maximum blister width of 3 mm to less than 5 mm |
| 2 | Maximum blister width of 5 mm to less than 7 mm |
| 1 | Maximum blister width of 7 mm or more |

Samples passed both the coating material adhesion test and the corrosion resistance test were judged good.

TABLE 3

Evaluation Results of Hot-Dip Galvanized Steel Sheet

| Film Formation Method | Treating Solution of Liquid Phase Process | Target of Vapor Phase Process | Content of Additional Element in Film (atom % by number) F | Mg | Al | Zn | Ni | Co | Naked Corrosion Resistance | Coating Adhesion | Coating Corrosion Resistance | Remarks |
|---|---|---|---|---|---|---|---|---|---|---|---|---|
| liquid phase process (cathodic electrolysis) | (1) | — | 5 | 0 | 0 | 0 | 0 | 0 | BB | passed | passed | Invention |
| liquid phase process (cathodic electrolysis) | (2) | — | 10 | 0 | 0 | 0 | 0 | 0 | BB | passed | passed | Invention |
| liquid phase process (cathodic electrolysis) | (3) | — | 30 | 0 | 0 | 0 | 0 | 0 | BB | passed | passed | Invention |
| liquid phase process (cathodic electrolysis) | (4) | — | 5 | 0 | 0 | 0 | 0 | 0 | BB | passed | passed | Invention |
| liquid phase process (cathodic electrolysis) | (5) | — | 10 | 0 | 0 | 0 | 0 | 0 | BB | passed | passed | Invention |
| liquid phase process (cathodic electrolysis) | (6) | — | 30 | 0 | 0 | 0 | 0 | 0 | BB | passed | passed | Invention |
| liquid phase process (cathodic electrolysis) | (7) | — | 20 | 0 | 0 | 0 | 0 | 0 | BB | passed | passed | Invention |
| liquid phase process (cathodic electrolysis) | (8) | — | 5 | 0 | 0 | 20 | 0 | 0 | AA | passed | passed | Invention |
| liquid phase process (cathodic electrolysis) | (9) | — | 10 | 0 | 0 | 20 | 0 | 0 | AA | passed | passed | Invention |
| liquid phase process (cathodic electrolysis) | (10) | — | 30 | 0 | 0 | 20 | 0 | 0 | AA | passed | passed | Invention |
| liquid phase process (cathodic electrolysis) | (11) | — | 5 | 10 | 0 | 0 | 0 | 0 | AA | passed | passed | Invention |
| liquid phase process (cathodic electrolysis) | (12) | — | 10 | 10 | 0 | 0 | 0 | 0 | AA | passed | passed | Invention |
| liquid phase process (cathodic electrolysis) | (13) | — | 30 | 10 | 0 | 0 | 0 | 0 | AA | passed | passed | Invention |
| liquid phase process (cathodic electrolysis) | (14) | — | 5 | 0 | 15 | 0 | 0 | 0 | AA | passed | passed | Invention |
| liquid phase process (cathodic electrolysis) | (15) | — | 10 | 0 | 15 | 0 | 0 | 0 | AA | passed | passed | Invention |
| liquid phase process (cathodic electrolysis) | (16) | — | 30 | 0 | 15 | 0 | 0 | 0 | AA | passed | passed | Invention |
| liquid phase process (cathodic electrolysis) | (17) | — | 5 | 0 | 0 | 0 | 2 | 0 | BB | passed | passed | Invention |
| liquid phase process (cathodic electrolysis) | (18) | — | 10 | 0 | 0 | 0 | 2 | 0 | BB | passed | passed | Invention |
| liquid phase process (cathodic electrolysis) | (19) | — | 30 | 0 | 0 | 0 | 2 | 0 | BB | passed | passed | Invention |
| liquid phase process (cathodic electrolysis) | (20) | — | 5 | 0 | 0 | 0 | 0 | 2 | BB | passed | passed | Invention |
| liquid phase process (cathodic electrolysis) | (21) | — | 10 | 0 | 0 | 0 | 0 | 2 | BB | passed | passed | Invention |
| liquid phase process (cathodic electrolysis) | (22) | — | 30 | 0 | 0 | 0 | 0 | 2 | BB | passed | passed | Invention |
| vapor phase process | — | $SiO_2$ | 0 | 0 | 0 | 0 | 0 | 0 | CC | not passed | not passed | Comparison |
| vapor phase process | — | $TiO_2$ | 0 | 0 | 0 | 0 | 0 | 0 | DD | not passed | not passed | Comparison |
| vapor phase process | — | $ZrO_2$ | 0 | 0 | 0 | 0 | 0 | 0 | DD | not passed | not passed | Comparison |

TABLE 4

Evaluation Results of 55% Al—43.3% Zn—1.6% Si Alloy-Plated Steel Sheet

| Film Formation Method | Treating Solution of Liquid Phase Process | Target of Vapor Phase Process | Content of Additional Element in Film (atom % by number) F | Mg | Al | Zn | Ni | Co | Coating Adhesion | Coating Corrosion Resistance | Remarks |
|---|---|---|---|---|---|---|---|---|---|---|---|
| liquid phase process (cathodic electrolysis) | (1) | — | 5 | 0 | 0 | 0 | 0 | 0 | passed | passed | Invention |
| liquid phase process (cathodic electrolysis) | (2) | — | 10 | 0 | 0 | 0 | 0 | 0 | passed | passed | Invention |
| liquid phase process (cathodic electrolysis) | (3) | — | 30 | 0 | 0 | 0 | 0 | 0 | passed | passed | Invention |
| liquid phase process (cathodic electrolysis) | (4) | — | 5 | 0 | 0 | 0 | 0 | 0 | passed | passed | Invention |
| liquid phase process (cathodic electrolysis) | (5) | — | 10 | 0 | 0 | 0 | 0 | 0 | passed | passed | Invention |
| liquid phase process (cathodic electrolysis) | (6) | — | 30 | 0 | 0 | 0 | 0 | 0 | passed | passed | Invention |
| liquid phase process (cathodic electrolysis) | (7) | — | 20 | 0 | 0 | 0 | 0 | 0 | passed | passed | Invention |
| liquid phase process (dipping) | (1) | — | 5 | 0 | 5 | 5 | 0 | 0 | passed | passed | Invention |
| liquid phase process (dipping) | (2) | — | 10 | 0 | 5 | 5 | 0 | 0 | passed | passed | Invention |
| liquid phase process (dipping) | (3) | — | 30 | 0 | 5 | 5 | 0 | 0 | passed | passed | Invention |
| vapor phase process | — | $SiO_2$ | 0 | 0 | 0 | 0 | 0 | 0 | not passed | not passed | Comparison |
| vapor phase process | — | $TiO_2$ | 0 | 0 | 0 | 0 | 0 | 0 | not passed | not passed | Comparison |
| vapor phase process | — | $ZrO_2$ | 0 | 0 | 0 | 0 | 0 | 0 | not passed | not passed | Comparison |

TABLE 5

Evaluation Results of Zn—11% Al—3% Mg—0.2% Si Alloy-Plated Steel Sheet

| Film Formation Method | Treating Solution of Liquid Phase Process | Target of Vapor Phase Process | Content of Additional Element in Film (atom % by number) F | Mg | Al | Zn | Ni | Co | Coating Adhesion | Coating Corrosion Resistance | Remarks |
|---|---|---|---|---|---|---|---|---|---|---|---|
| liquid phase process (cathodic electrolysis) | (17) | — | 5 | 0 | 0 | 0 | 2 | 0 | passed | passed | Invention |
| liquid phase process (cathodic electrolysis) | (18) | — | 10 | 0 | 0 | 0 | 2 | 0 | passed | passed | Invention |
| liquid phase process (cathodic electrolysis) | (19) | — | 30 | 0 | 0 | 0 | 2 | 0 | passed | passed | Invention |
| liquid phase process (cathodic electrolysis) | (20) | — | 5 | 0 | 0 | 0 | 0 | 2 | passed | passed | Invention |
| liquid phase process (cathodic electrolysis) | (21) | — | 10 | 0 | 0 | 0 | 0 | 2 | passed | passed | Invention |
| liquid phase process (cathodic electrolysis) | (22) | — | 30 | 0 | 0 | 0 | 0 | 2 | passed | passed | Invention |
| liquid phase process (dipping) | (1) | — | 5 | 0 | 2 | 5 | 0 | 0 | passed | passed | Invention |
| liquid phase process (dipping) | (2) | — | 10 | 0 | 2 | 5 | 0 | 0 | passed | passed | Invention |
| liquid phase process (dipping) | (3) | — | 30 | 0 | 2 | 5 | 0 | 0 | passed | passed | Invention |
| vapor phase process | — | $SiO_2$ | 0 | 0 | 0 | 0 | 0 | 0 | not passed | not passed | Comparison |
| vapor phase process | — | $TiO_2$ | 0 | 0 | 0 | 0 | 0 | 0 | not passed | not passed | Comparison |
| vapor phase process | — | $ZrO_2$ | 0 | 0 | 0 | 0 | 0 | 0 | not passed | not passed | Comparison |

TABLE 6

Evaluation Results of Aluminum Alloy Sheet

| Film Formation Method | Treating Solution of Liquid Phase Process | Target of Vapor Phase Process | Content of Additional Element in Film (atom % by number) F | Mg | Al | Zn | Ni | Co | Coating Adhesion | Coating Corrosion Resistance | Remarks |
|---|---|---|---|---|---|---|---|---|---|---|---|
| liquid phase process (cathodic electrolysis) | (8) | — | 5 | 0 | 0 | 20 | 0 | 0 | passed | passed | Invention |
| liquid phase process (cathodic electrolysis) | (9) | — | 10 | 0 | 0 | 20 | 0 | 0 | passed | passed | Invention |
| liquid phase process (cathodic electrolysis) | (10) | — | 30 | 0 | 0 | 20 | 0 | 0 | passed | passed | Invention |
| vapor phase process | — | $SiO_2$ | 0 | 0 | 0 | 0 | 0 | 0 | not passed | not passed | Comparison |
| vapor phase process | — | $TiO_2$ | 0 | 0 | 0 | 0 | 0 | 0 | not passed | not passed | Comparison |
| vapor phase process | — | $ZrO_2$ | 0 | 0 | 0 | 0 | 0 | 0 | not passed | not passed | Comparison |

TABLE 7

Evaluation Results of Stainless Steel Sheet

| Film Formation Method | Treating Solution of Liquid Phase Process | Target of Vapor Phase Process | Content of Additional Element in Film (atom % by number) F | Mg | Al | Zn | Ni | Co | Coating Adhesion | Coating Corrosion Resistance | Remarks |
|---|---|---|---|---|---|---|---|---|---|---|---|
| liquid phase process (cathodic electrolysis) | (11) | — | 5 | 10 | 0 | 0 | 0 | 0 | passed | passed | Invention |
| liquid phase process (cathodic electrolysis) | (12) | — | 10 | 10 | 0 | 0 | 0 | 0 | passed | passed | Invention |
| liquid phase process (cathodic electrolysis) | (13) | — | 30 | 10 | 0 | 0 | 0 | 0 | passed | passed | Invention |
| liquid phase process (cathodic electrolysis) | (14) | — | 5 | 0 | 15 | 0 | 0 | 0 | passed | passed | Invention |
| liquid phase process (cathodic electrolysis) | (15) | — | 10 | 0 | 15 | 0 | 0 | 0 | passed | passed | Invention |
| liquid phase process (cathodic electrolysis) | (16) | — | 30 | 0 | 15 | 0 | 0 | 0 | passed | passed | Invention |
| vapor phase process | — | $SiO_2$ | 0 | 0 | 0 | 0 | 0 | 0 | not passed | not passed | Comparison |
| vapor phase process | — | $TiO_2$ | 0 | 0 | 0 | 0 | 0 | 0 | not passed | not passed | Comparison |
| vapor phase process | — | $ZrO_2$ | 0 | 0 | 0 | 0 | 0 | 0 | not passed | not passed | Comparison |

The evaluations results in the above-described tests are shown in Tables 3 to 7 every each metal sheet. It is apparent that the naked corrosion resistance, coating film adhesion and coating film corrosion resistance all are improved by the present invention.

INDUSTRIAL APPLICABILITY

According to the present invention, a chemical conversion-treated metal sheet excellent in the corrosion resistance and adhesion of coating film and small in the environmental load can be provided even without using a chromium-containing film, which is industrially useful.

The invention claimed is:

1. A chemical conversion-treated metal sheet comprising a metal sheet having on at least one surface thereof an inorganic film, wherein said inorganic film is a film having a metal component, said inorganic film comprising one or both of a metal oxide and a metal hydroxide, and said film containing F bonded to the metal of the metal component, said film containing no Cr, said one or both of said metal oxide and metal hydroxide comprising 50 atom % or more of all atoms in said film after subtracting all said F atoms from said film, and F content in said film is from 1 atom % to less than 60 atom % based on all atoms in said film; and at least a part of the metal component of said film has both a chemical bond to O and a chemical bond to F.

2. The chemical conversion-treated metal sheet as claimed in claim 1, wherein the content of said one or both of said metal oxide and said metal hydroxide is 80 atom % or more of all atoms in said film after subtracting all F atoms from said film.

3. The chemical conversion-treated metal sheet as claimed in claim 1, wherein the content of said one or both of said metal oxide and said metal hydroxide is 90 atom % or more of all atoms in said film after subtracting all F atoms from said film.

4. The chemical conversion-treated metal sheet as claimed in claim 1, wherein the content of F in said film is from 3 atom % to 35 atom % based on all atoms in said film.

5. The chemical conversion-treated metal sheet as claimed in claim 1, wherein the content of F in said film is from 5 atom % to 30 atom % based on all atoms in said film.

6. The chemical conversion-treated metal sheet as claimed in claim 1, wherein the metal component of said film is one or more member selected from the group consisting of Ti, Zr and Si.

7. The chemical conversion-treated metal sheet as claimed in claim 6, wherein said film further contains, as an additional element, one or more element selected from the group consisting of Mg, Al, Zn, Ni and Co.

8. The chemical conversion-treated metal sheet as claimed in claim 7, wherein the content of the additional element in said film is such that the Zn content is from 0.1 atom % to less than 50 atom % based on all atoms in said film.

9. The chemical conversion-treated metal sheet as claimed in claim 7, wherein the content of the additional element in said film is such that the Al content is from 1 atom % to less than 30 atom % based on all atoms in said film.

10. The chemical conversion-treated metal sheet as claimed in claim 7, wherein the content of the additional element in said film is such that the Mg content is from 1 atom % to less than 30 atom % based on all atoms in said film.

11. The chemical conversion-treated metal sheet as claimed in claim 7, wherein the content of the additional element in said film is such that the Ni content is from 1 atom % to less than 30 atom % based on all atoms in said film.

12. The chemical conversion-treated metal sheet as claimed in claim 7, wherein the content of the additional element in said film is such that the Co content is from 1 atom % to less than 30 atom % based on all atoms in said film.

13. The chemical conversion-treated metal sheet as claimed in claim 7, wherein each additional element in said film has a bond to O or F or both a bond to O and a bond to F.

* * * * *